US010401129B2

(12) United States Patent
Armstrong et al.

(10) Patent No.: US 10,401,129 B2
(45) Date of Patent: Sep. 3, 2019

(54) INTERDICTION AND RECOVERY FOR SMALL UNMANNED AIRCRAFT SYSTEMS

(71) Applicant: Kestrel Science and Innovation, LLC, Chandler, AZ (US)

(72) Inventors: Michael J. Armstrong, Avon, IN (US); George R. Hutchins, Avon, IN (US); Timothy A. Wachob, Gilbert, AZ (US)

(73) Assignee: KESTREL SCIENCE AND INNOVATION, LLC, Chandler, AZ (US)

( * ) Notice: Subject to any disclaimer, the term of this patent is extended or adjusted under 35 U.S.C. 154(b) by 0 days.

(21) Appl. No.: 15/457,490

(22) Filed: Mar. 13, 2017

(65) Prior Publication Data

US 2017/0261292 A1 Sep. 14, 2017

Related U.S. Application Data

(60) Provisional application No. 62/307,456, filed on Mar. 12, 2016.

(51) Int. Cl.

| | |
|---|---|
| ***F42B 12/00*** | (2006.01) |
| ***F41H 13/00*** | (2006.01) |
| ***F42B 12/56*** | (2006.01) |

(52) U.S. Cl.

CPC ..... *F41H 13/0006* (2013.01); *F42B 12/56* (2013.01)

(58) Field of Classification Search

CPC ..... F41H 13/0006; F42B 12/56

See application file for complete search history.

(56) References Cited

U.S. PATENT DOCUMENTS

| | | | | |
|---|---|---|---|---|
| 4,271,761 | A | 6/1981 | Canning et al. | |
| 5,750,918 | A | 5/1998 | Mangolds et al. | |
| 5,898,125 | A * | 4/1999 | Mangolds | F41H 13/0006 102/293 |
| 6,325,015 | B1 * | 12/2001 | Garcia et al. | B63B 21/56 244/110 F |
| 6,626,077 | B1 | 9/2003 | Gilbert | |
| 7,328,644 | B2 * | 2/2008 | Vickroy | F41H 11/02 102/405 |
| 7,444,939 | B2 | 11/2008 | Mcnulty et al. | |
| 8,205,537 | B1 * | 6/2012 | Dupont | F41H 13/0006 102/504 |
| 8,915,191 | B2 | 12/2014 | Jones | |

(Continued)

FOREIGN PATENT DOCUMENTS

| | | | | |
|---|---|---|---|---|
| DE | 102009006498 | A1 * | 7/2010 | F41H 11/02 |
| GB | 2537664 | A * | 10/2016 | F41H 13/0006 |
| GB | 2538826 | A * | 11/2016 | F41H 11/02 |

OTHER PUBLICATIONS

PCT/US2017/022148 International Search Report and Written Opinion dated Jun. 2, 2017.

(Continued)

*Primary Examiner* — Gabriel J. Klein

(74) *Attorney, Agent, or Firm* — Kunzler Bean & Adamson, PC

(57) ABSTRACT

Apparatuses, systems, and methods are disclosed for drone interdiction. A projectile is capable of being launched to intercept a drone. The projectile may include a set of tethers that deploy from the projectile for securing the drone. The projectile may include a recovery device that deploys from the projectile for controlling a descent of the drone.

17 Claims, 5 Drawing Sheets

(56) References Cited

U.S. PATENT DOCUMENTS

| | | | | |
|---|---|---|---|---|
| 2007/0261542 | A1* | 11/2007 | Chang | F41H 11/02 89/1.11 |
| 2010/0181424 | A1* | 7/2010 | Goossen | F41H 13/0006 244/110 F |
| 2011/0005373 | A1* | 1/2011 | Martinez | B63G 9/04 89/1.34 |
| 2011/0101097 | A1 | 5/2011 | Olden et al. | |
| 2014/0216290 | A1* | 8/2014 | Yee | F41H 11/02 102/374 |
| 2016/0376029 | A1* | 12/2016 | Sekiya | F41H 11/02 244/110 F |
| 2017/0356726 | A1* | 12/2017 | Theiss | B64C 39/024 |
| 2018/0162530 | A1* | 6/2018 | Klein | B64C 39/02 |
| 2018/0245888 | A1* | 8/2018 | Banga | F41H 11/02 |

OTHER PUBLICATIONS

Openworks Engineering, "SkyWall: Capture Drones-Protect Assets", <https://web.archive.org/web/20160308190100/http://openworksengineering.com:80/images/skywall/SkyWall%20Brochure.pdf>.

SkyWall 100: An anti-drone bazooka, Made by UK company OpenWorks, the bazooka will help the police control the skies, https://arstechnica.com/gadgets/2016/03/skywal-lantidronebazooka/, Feb. 22, 2017.

PCT/US2017/022148 International Preliminary Report on Patentability dated Sep. 27, 2018.

* cited by examiner

INTERDICTION AND RECOVERY FOR SMALL UNMANNED AIRCRAFT SYSTEMS

CROSS-REFERENCES TO RELATED APPLICATIONS

This application claims the benefit of U.S. Provisional Patent Application No. 62/307,456 entitled "Small UAS Physical Interdiction and Recovery System" and filed on Mar. 12, 2016 for Michael James Armstrong et al., which is incorporated herein by reference.

FIELD

This present disclosure, in various embodiments, relates to drone aircraft and more particularly relates to interdiction and recovery for small unmanned aircraft systems.

BACKGROUND

Unmanned aircraft systems, also known as drones, may be controlled by a remote or ground-based operator, or may operate autonomously under computer control. Drones are used for a variety of purposes such as photography, film-making, mapping, security, surveillance, search and rescue, atmospheric research, package delivery, and the like. Military drones may include reconnaissance or missile payloads, or the like.

Small unmanned aircraft systems, or drones, have become increasingly available to civilians in recent years. For example, battery powered quadcopters may be inexpensively obtained, and are widely used. Increasing drone use may pose safety or security threats to people or businesses. For example, a business with trade secrets may not welcome drone overflights by competitors. Similarly, an event venue that forbids photography for people within the venue may also wish to prevent drone based photography. Drone use by paparazzi, stalkers, or the like may threaten individual privacy interests. Many further scenarios exist in which people may wish to interdict, intercept, or disable drones.

A variety of technologies have been developed to intercept, destroy or disable drones in military scenarios. However, military drone interdiction technology may be dangerous and/or unsuitable for use by or around civilians.

SUMMARY

Apparatuses for drone interdiction are disclosed. An apparatus, in one embodiment, includes a projectile capable of being launched to intercept a drone. In a certain embodiment, the projectile includes a set of tethers that deploy from the projectile for securing the drone. In a further embodiment, the projectile includes a recovery device that deploys from the projectile for controlling a descent of the drone.

In one embodiment, the projectile includes a set of darts that deploy from the projectile. In a further embodiment, the tethers couple the darts to the projectile such that deploying the darts deploys the tethers. In a certain embodiment, the projectile includes a set of spools that store the set of tethers within the projectile. In a further embodiment, a spool is insertable and removable from the projectile for loading a tether, and is retained within the projectile when the tether is deployed. In some embodiments, a tether includes a metallic wire.

In one embodiment, an apparatus comprises a cartridge for launching the projectile. In a certain embodiment, the cartridge includes a cartridge casing, propellant, primer, and the projectile. In a further embodiment, the cartridge is compatible with a 37 mm flare launcher, or a 40 mm grenade launcher. In an additional embodiment, an apparatus includes a second cartridge compatible with a launcher for the cartridge. In a certain embodiment, the second cartridge includes a projectile for intercepting a drone. In a further embodiment, the projectile of the second cartridge includes a payload different from the set of tethers. In some embodiments, the payload for the second cartridge may include one or more of a birdshot payload, an electromagnetic pulse generator payload, an incendiary payload, a marker payload and/or a tracking device payload.

In one embodiment, the projectile comprises a payload portion. In a certain embodiment, the payload portion includes the set of tethers. In a further embodiment, an apparatus includes one or more additional payload portions interchangeable with the payload portion that includes the set of tethers.

In one embodiment, the projectile includes a plurality of pyrotechnic charges for deploying the set of tethers and the recovery device, and trigger electronics for activating the pyrotechnic charges. In a certain embodiment, the projectile is configured to deploy the set of tethers based on range information communicated to the projectile from a device separate from the projectile, range information set by a user prior to launching the projectile, a delay time, and/or target detection by the projectile.

In one embodiment, the set of tethers and the recovery device remain coupled to the projectile after being deployed, such that the projectile is recoverable with the drone. In a certain embodiment, the projectile is reusable by replacing the set of tethers, repackaging the recovery device, and reloading one or more pyrotechnic charges.

In one embodiment, the projectile is weight-stabilized. In a certain embodiment, the projectile includes a head portion and an aft portion. In a further embodiment, the head portion may include one or more weights and the aft portion may include a composite material.

Systems for drone interdiction are disclosed. A system, in one embodiment, includes a cartridge. In a certain embodiment, a cartridge includes a projectile for intercepting a drone. In a further embodiment, a set of tethers deploy from the projectile for securing the drone. In an additional embodiment, a recovery device that deploys from the projectile for controlling a descent of the drone. In one embodiment, a system includes a launcher for firing a cartridge to launch a projectile.

In one embodiment, a ground-based targeting device determines range information for the drone and communicates with the projectile. In a certain embodiment, a projectile includes communication electronics that receive information from a targeting device, and trigger electronics that activate one or more pyrotechnic charges to deploy a set of tethers. In a further embodiment, a targeting device communicates with a projectile using short-link wireless radio telecommunications.

In one embodiment, a system includes a second cartridge compatible with the launcher. In a certain embodiment, the second cartridge includes a projectile for intercepting a drone. In a further embodiment, the projectile of the second cartridge includes a payload different from the set of tethers.

A system, in another embodiment, includes a flare-gun compatible cartridge. The flare-gun compatible cartridge, in one embodiment, includes a projectile for intercepting a drone. In a certain embodiment, the projectile includes a first payload portion, and the first payload portion includes a first payload that deploys from the projectile to disable the drone.

In a further embodiment, a plurality of additional payload portions are interchangeable with the first payload portion. In a certain embodiment, at least one of the additional payload portions may include a payload that deploys from the projectile to disable the drone in a different way than the first payload.

In one embodiment, the first payload includes a set of tethers that deploy from the projectile for securing the drone. In a further embodiment, and the projectile includes a recovery device that deploys from the projectile for controlling a descent of the drone.

BRIEF DESCRIPTION OF THE DRAWINGS

In order that the advantages of the disclosure will be readily understood, a more particular description of the disclosure briefly described above will be rendered by reference to specific embodiments that are illustrated in the appended drawings. Understanding that these drawings depict only typical embodiments of the disclosure and are not therefore to be considered to be limiting of its scope, the subject matter of the present application will be described and explained with additional specificity and detail through the use of the accompanying drawings, in which.

DETAILED DESCRIPTION

Figure 1A:
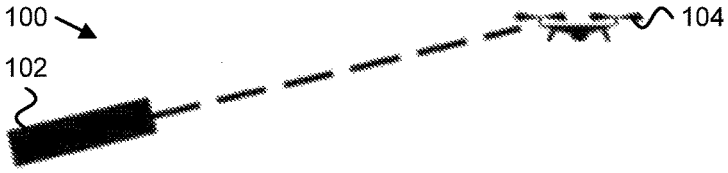
FIG. 1A is a side view illustrating one embodiment of a system for drone interdiction targeting a drone.

Reference throughout this specification to "one embodiment," "an embodiment," or similar language means that a particular feature, structure, or characteristic described in connection with the embodiment is included in at least one embodiment. Thus, appearances of the phrases "in one embodiment," "in an embodiment," and similar language throughout this specification may, but do not necessarily, all refer to the same embodiment, but mean "one or more but not all embodiments" unless expressly specified otherwise. The terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

Furthermore, the described features, structures, or characteristics of the disclosure may be combined in any suitable manner in one or more embodiments. In the following description, numerous specific details are disclosed to provide a thorough understanding of embodiments of the disclosure. One skilled in the relevant art will recognize, however, that the disclosure may be practiced without one or more of the specific details, or with other methods, components, materials, and so forth. In other instances, well-known structures, materials, or operations are not shown or described in detail to avoid obscuring aspects of the disclosure.

In the following description, certain terms may be used such as "up," "down," "upper," "lower," "horizontal," "vertical," "left," "right," and the like. These terms are used, where applicable, to provide some clarity of description when dealing with relative relationships. However, these terms are not intended to imply absolute relationships, positions, and/or orientations. For example, with respect to an object, an "upper" surface can become a "lower" surface simply by turning the object over. Nevertheless, it is still the same object.

FIGS. 1A-1F depict one embodiment of a system 100 for drone interdiction, at various stages of operation. In the depicted embodiment, the system 100 includes a launcher 102, and a projectile 106 for intercepting a drone 104. The drone 104 is depicted to show the operation of the system 100 for drone interdiction, but is not a part of the system 100, in the depicted embodiment. In general, a user of the system 100 may wish to prevent operation of a drone 104 by another person or organization, and may use the system to 100 to secure and recover the drone 104, or to otherwise prevent or interdict drone usage.

A drone 104, in various embodiments, may refer to any unmanned aircraft. In a certain embodiment, a drone 104 intercepted using a system 100 may be a small unmanned aircraft. For example, a drone 104 may be within the 55 lb. weight limit established by the Federal Aviation Administration (FAA) for small unmanned aircraft. In another embodiment, a drone 104 may be a model aircraft, or the like. In certain embodiments, the system 100 may be used to intercept larger drones 104 (e.g., aircraft above the FAA 55 lb. weight limit).

In general, in various embodiments, a projectile 106 is capable of being launched to intercept a drone 104, and the launcher 102 launches the projectile 106. In certain embodiments, the launcher 102 may launch a projectile 106 by firing a cartridge. For example, the projectile 106 may be packaged in a 37 mm flare cartridge, a 40 mm grenade cartridge, or the like, and the launcher 102, correspondingly may be a 37 mm flare gun, a 40 mm grenade launcher, or the like. In another embodiment, a launcher 102 may launch a projectile 106 without the use of a cartridge (e.g., using compressed air, using an explosive propellant not contained in a cartridge, or the like).

FIG. 1A depicts the launcher 102 targeting a drone 104. In one embodiment, a user may target the launcher 102 at a drone 104. For example, a person may manually or visually aim a 37 mm flare gun, a 40 mm grenade launcher at a drone 104. In another embodiment, the launcher 102 may be aimed by a targeting device. For example, the launcher 102, the projectile 106, or a separate device may include a targeting device that uses laser ranging, radar, sound, echolocation, or the like to locate a drone 104, and the targeting device may control or communicate with one or more motors to aim the launcher 102. In another embodiment, a user may use information from a targeting device for guidance in aiming a launcher 102. Various ways to target a launcher 102 at a drone 104 will be clear in view of this disclosure.

Figure 1B:
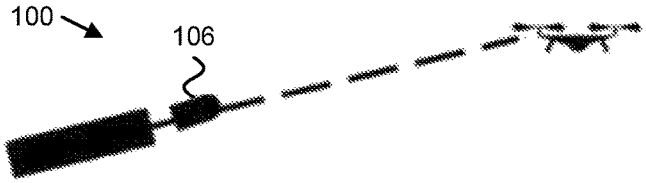
FIG. 1B is a side view illustrating one embodiment of a system for drone interdiction launching a projectile.

FIG. 1B depicts the launcher 102 launching a projectile 106. As described above, the projectile 106 may be launched from a cartridge, launched using compressed air, or the like. In various embodiment, a projectile 106 may refer to any object capable of being launched to intercept a drone 104, whether the projectile 106 is ballistically launched, rocket propelled, or the like. In one embodiment, the projectile 106 may be launched based on a user manually operating a triggering for the launcher 102. In another embodiment, the launcher 102 may be automatically triggered to launch the projectile 106. In a certain embodiment, using a combination of automatic and manual control, a user may operate a trigger to enable the launcher 102, and the launcher 102 may launch the projectile 106 when the trigger is depressed and a targeting system confirms that the launcher 102 is aimed correctly. Various ways to initiate a launch and to propel a projectile 106 will be clear in view of this disclosure.

Figure 1C:
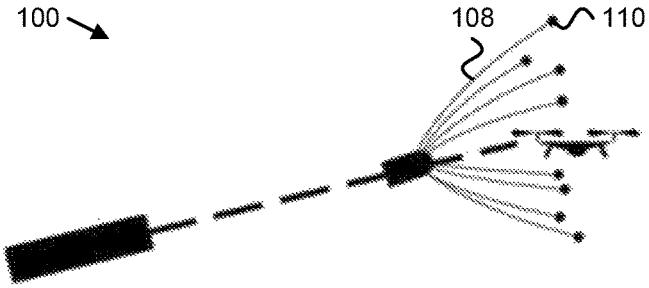
FIG. 1C is a side view illustrating one embodiment of a system for drone interdiction deploying tethers.

FIG. 1C depicts the projectile 106 deploying tethers 108 for securing the drone 104. In various embodiments, a projectile 106 capable of being launched to intercept a drone 104 may include a set of tethers 108 that deploy from the projectile 106 for securing the drone 104. In various embodiments, a tether 108 may refer to a cord, wire, line, or other flexible linear member, and a set of tethers 108 may refer to one or more tethers 108.

In general, in various embodiments, deploying a tether 108 may refer to releasing, launching, or otherwise ejecting at least one end of the tether 108 from the projectile 106. In a further embodiment, another end of a tether 108 may remain connected to the projectile 106 when the tether 108 is deployed, so that the tether 108 extends, unspools, or the like from the projectile 106. In certain embodiments, tethers 108 may be weighted to facilitate launching. For example, in the depicted embodiment, the tethers 108 are coupled to small weights 110 (e.g., weighted darts as described below with reference to FIGS. 3, 6A, and 6B), and the projectile 106 deploys the tethers 108 by deploying or launching the weights 110. In another embodiment, the tethers 108 themselves may be weighted lines, instead of being attached to separate weights 110. In another embodiment, however, non-weighted tethers 108 may be deployed from a projectile 106.

In the depicted embodiment, a plurality of tethers 108 are deployed from the projectile 106 in various directions, but generally towards the drone 104. In certain embodiments, deploying a plurality of tethers 108 may increase the likelihood that one or more of the tethers 108 engages the drone 104. In another embodiment, however, a projectile 106 may deploy a single tether 108 (e.g., with accurate targeting). In various embodiments, tethers 108 may secure a drone 104 by wrapping around one or more portions of a drone 104, fouling one or more propellers, increasing weight or drag for the drone 104 and/or otherwise restricting the free movement of the drone 104.

In some embodiments, the projectile 106 may deploy the tethers 108 pyrotechnically by activating one or more charges, electromagnetically, or by using compressed air or the like. In various embodiments, the projectile 106 may deploy the tethers 108 in response to various triggers or events. For example, in one embodiment, a projectile 106 may deploy the tethers 108 in response to a delay time elapsing since the projectile 106 was launched, and a delay time may be manually set by a user, configured by a manufacturer of the projectile 106, or the like. In another embodiment, the projectile 106 may deploy tethers 108 based on range information. In various embodiments, range information may include any information relating to the position of the drone 104 relative to the projectile 106, the launcher 102, or another known position (e.g., a position of a separate targeting device). Range information may include a distance, a time to intercept, a distance converted to a time based on muzzle velocity, or the like. In certain embodiments, range information may be communicated to the projectile 106 from a device separate from the projectile 106, such as a separate targeting or rangefinding device. In another embodiment, range information may be set by a user prior to launching the projectile 106. For example, the projectile 106 may include a way for a user to set an expected range, delay time, or the like. In another embodiment, the projectile 106 may deploy tethers 108 based on target detection by the projectile 106. For example, the projectile 106 may include a laser ranging device, radar ranging device, echolocation device, proximity sensor, or the like, and may deploy tethers 108 based on detected proximity to the drone 104.

In one embodiment, the projectile 106 may be configured to selectively deploy the tethers 108. For example, in a certain embodiment, the projectile 106 may not deploy the tethers 108, based on range information indicating that the drone 104 is too far away (e.g., the projectile 106 missed, or the drone 104 avoided the projectile 106). In another embodiment, the projectile 106 may non-selectively deploy the tethers 108 (e.g., using a delay fuse, regardless of whether the drone 104 is actually in range).

In a certain embodiment, a tether 108 may include a material that is flexible for engaging the drone 104, but strong so that the tether 108 will not be chopped up by a propeller, broken by the drone 104 flying away or the like. In a certain embodiment, a tether 108 may comprise a metallic wire. In a further embodiment, a metallic wire may be made of a material that is capable of withstanding a temperature spike from being pyrotechnically launched (e.g., that does not deform significantly at pyrotechnic launch temperatures). For example, in one embodiment, a tether 108 may be a nichrome wire. In a certain embodiment, a tether 108 may be a narrow-gauge wire. In general, narrowing a wire increases a length of the wire that can be stored in the projectile 106, thus increasing the likelihood of the tether 108 engaging the drone 104. For example, in one embodiment, the tether 108 may be a 34 gauge nichrome wire. However, in another embodiment, another gauge or material may be used in a tether 108. For example, a tether 108 may include an aramid fiber (e.g., Kevlar), a multifilament fiber or wire, a single-filament fiber or wire, or the like. Various materials for tethers 108 that are flexible enough to be spooled in the projectile 106 and extend at deployment, and strong enough to secure a drone 104, will be clear in view of this disclosure.

Figure 1D:
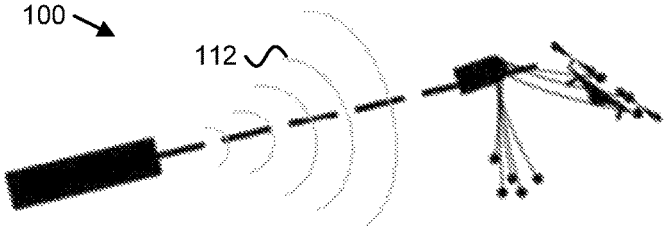
FIG. 1D is a side view illustrating one embodiment of a system for drone interdiction disabling a drone.

FIG. 1D depicts the system 100 disabling the drone 104. The tethers 108 secure and/or disable the drone 104 by wrapping around the drone 104, limiting motion, fouling propellers, preventing control surfaces from operating, and/or the like. Additionally, in certain embodiment, a jamming signal 112 may be emitted by the launcher 102, the projectile 106, or the like to disrupt communication between the drone 104 and a ground-based operator, thereby preventing the operator from controlling the drone 104, receiving information or the drone 104, or the like. In another embodiment, however, a system 100 may disable a drone 104 using tethers 108 without the use of a jamming signal 112, as jamming may introduce issues with collateral damage to other electrical devices, regulatory issues or the like.

Figure 1E:
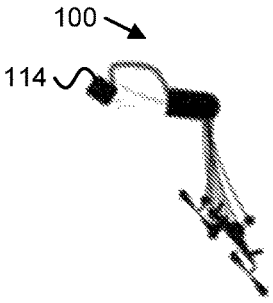
FIG. 1E is a side view illustrating one embodiment of a system for drone interdiction deploying a recovery device.
Figure 1F:
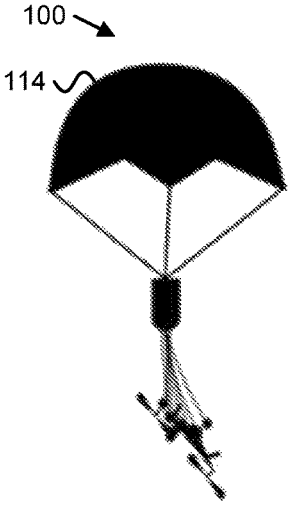
FIG. 1F is a side view illustrating one embodiment of a system for drone interdiction using a recovery device to control descent of a drone.

FIGS. 1E and 1F depict the projectile 106 deploying a recovery device 114 and using the recovery device 114 to control descent of the drone 104. In certain embodiments, a secured or disabled drone 104 may be a safety hazard. For example, if the tethers 108 interfere with propulsion, control surfaces or the like, a drone 104 may fall or crash instead of landing normally. A rapidly descending drone 104 may injure people, damage property, or the like. Additionally, controlling the descent of a drone 104 may be useful for limiting damage to the drone 104, so that a user of the system 100 can examine the drone 104, determine what the drone 104 was doing, delete photos or video, return an interdicted but undamaged drone 104 to a neighbor, or the like.

In various embodiments, a recovery device 114 may refer to any device that controls the descent of a drone 104 by slowing a vertical speed of the drone 104 (in comparison to the vertical speed of a drone 104 falling or crashing without a recovery device 114). In the depicted embodiment, the recovery device 114 is a parachute. In another embodiment, a recovery device 114 may include one or more parachutes, one or more streamers that increase air resistance, one or more autorotating blades, a gliding airfoil that deploys from the projectile 106, or the like. Various types of recovery devices 114 for controlling descent of a drone 104 will be clear in view of this disclosure.

In some embodiments, the projectile 106 may deploy the recovery device 114 pyrotechnically by activating one or more charges, electromagnetically, or by using compressed air or the like. In various embodiments, the projectile 106 may deploy the recovery device 114 in response to various triggers or events. For example, in one embodiment, the projectile 106 may automatically deploy the recovery device 114 after a predetermined time, so that the projectile 106 has a controlled descent regardless of whether the drone 104 was secured, or whether the tethers 108 were even deployed. In another embodiment, the projectile 106 may deploy the recovery device 114 a predetermined time after deploying the tethers 108. In a further embodiment, the projectile 106 may deploy the recovery device 114 in response to an accelerometer detecting a jerk indicating that the drone 104 has been secured. Various ways of triggering deployment of a recovery device 114 will be clear in view of this disclosure.

In a certain embodiment, as depicted in FIG. 1F, the tethers 108 and the recovery device 114 remain coupled to the projectile 106 after being deployed. In a further embodiment, tethers 108 and a recovery device 114 that remain coupled to the projectile 106 after being deployed may control a descent of the drone 104 and the projectile 106, so that the projectile 106 is recoverable with the drone. For example, in the depicted embodiment, the tethers 108 are coupled to the projectile 106 at the non-deployed end of the tether, and the parachute lines are coupled to the projectile 106, so that the parachute controls the descent of the projectile 106 and the drone 104. Making the projectile 106 recoverable with the drone 104 may increase safety (by avoiding loose objects that might fall uncontrolled on unsuspecting people), and may facilitate reloading and reuse of the projectile 106, or the like.

In one embodiment, the projectile 106 may be configured for single use. In another embodiment, however, the projectile 106 may be reusable by replacing the set of tethers 108, repackaging the recovery device 114, and reloading one or more pyrotechnic charges (e.g., charges that were consumed by deploying the tethers 108 and the recovery device 114). Loading tethers 108 is described in further detail with regard to FIGS. 6A and 6B. In a further embodiment, a cartridge for launching the projectile 106 may also be reused by reloading a propellant, replacing a primer, reattaching the projectile 106 to the cartridge casing, and the like. In a certain embodiment, the projectile 106 may not deploy the tethers 108 and/or the recovery device 114 (e.g., if the projectile 106 misses the drone 104) and may be recovered and reused simply by reloading the projectile 106 in a cartridge.

Figure 2:
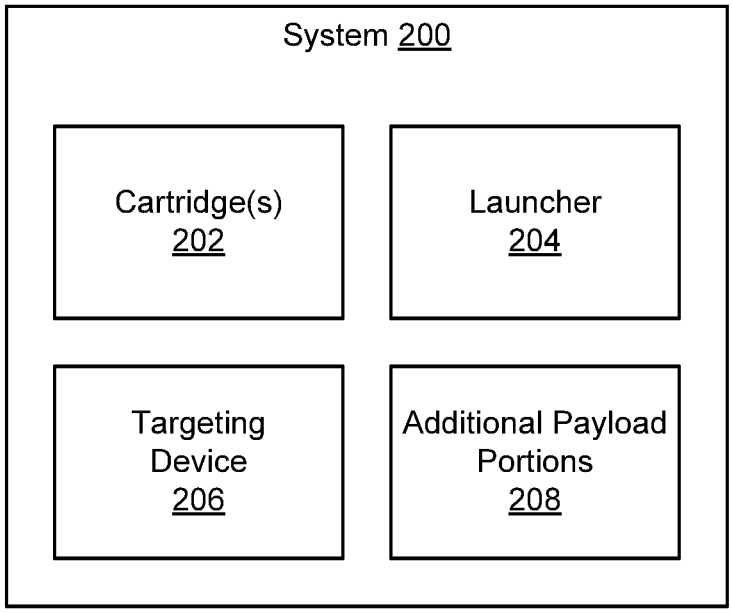
FIG. 2 is a schematic block diagram illustrating another embodiment of a system for drone interdiction.

FIG. 2 is a schematic block diagram illustrating another embodiment of a system 200 for drone interdiction. The system 200, in certain embodiments, may be substantially similar to the system 100 described above with reference to FIGS. 1A-1F, and may be used to launch one or more projectiles for drone interdiction. In the depicted embodiment, the system 100 includes one or more cartridges 202, a launcher 204, a targeting device 206, and one or more additional payload portions 208. In another embodiment, however, a system 200 may omit one or more of the depicted components. For example, in another embodiment, a system 200 may omit the targeting device 206 and may be manually aimed. In a certain embodiment, a system 200 may omit a launcher 204, and may provide cartridges 202 for use with a launcher the user already has. In some embodiments, the system 200 may include a cartridge 202 for drone interdiction, without additional cartridges or payload portions 208. In one embodiment, a system 200 may provide interchangeable cartridges 202 without additional payload portions 208. In another embodiment, a system 200 may include a cartridge 202 with interchangeable payload portions 208, but without additional cartridges 202. A variety of ways to provide a system 200 including some or all of the depicted components will be clear in view of this disclosure.

In the depicted embodiment, the system 200 includes one or more cartridges 202. An apparatus that includes a projectile similar to the projectile 106 of FIGS. 1A-1F may provide a cartridge 202 for launching the projectile, where the cartridge includes a cartridge casing, propellant, primer, and the projectile. Various suitable types of cartridge casing, propellant, primer, and the like will be clear in view of this disclosure. Certain embodiments of cartridges 202 are described in further detail below with reference to FIGS. 3 and 4.

In one embodiment, a cartridge 202 may be a 37 mm flare cartridge. In another embodiment, a cartridge 202 may be a 40 mm grenade cartridge. Similarly, a launcher 204 may be a 37 mm flare launcher 204, a 40 mm grenade launcher 204, or the like. In certain embodiments, a system 200 using a smooth bore 37 mm flare launcher 204 and compatible cartridges 202 may avoid being characterized as a restricted destructive device. A 37 mm or other flare-gun compatible cartridge 202, in certain embodiments, may be convenient for a user who already has a flare launcher for other reasons. In another embodiment, however, a system 200 using a 40 mm grenade launcher 204 and compatible cartridges 202 may provide greater muzzle velocity and range for drone interdiction. Various types of launchers 204, and various calibers and types of cartridges 202 compatible with such launchers 204 will be clear in view of this disclosure.

In certain embodiments, a system 200 may include a plurality of cartridges 202. For example, in one embodiment, multiple cartridges 202 may be provided including projectiles 106 as described with reference to FIGS. 1A-1F. Cartridges 202 may be fired in close succession for intercepting multiple drones, or if one projectile misses, or the like. In another embodiment, a system 200 may provide at least one cartridge 202 including a projectile 106 as described above (including a set of tethers 108), and the system 200 may further include a second cartridge 202 compatible with the launcher 204, where the second cartridge 202 includes a projectile for intercepting a drone with a payload different from the set of tethers. For example, the projectile of a second cartridge 202 may include a birdshot payload for destroying or disabling a drone, an electromagnetic pulse (EMP) generator payload for disabling drone electronics, an incendiary payload, a marker payload that marks the drone for later identification, a tracking device payload that secures a tracking device to the drone for tracking the drone back to a user, or the like.

In another embodiment, a cartridge 202 or projectile may include a payload portion that includes the set of tethers. In the depicted embodiment, additional payload portions 208 may be interchangeable with the payload portion that includes the tethers. In certain embodiments, a flare-gun compatible cartridge 202 may include a first payload portion with a first payload that deploys to disable a drone, and a system 200 may include a plurality of additional payload portions 208, interchangeable with the first payload portion, where at least one of the additional payload portions includes a payload that deploys from the projectile to disable the drone in a different way than the first payload. For example, in various embodiments, interchangeable payload portions 208 may include payloads such as birdshot, an EMP generator, an incendiary, tracking, or marking payload, or the like, as described above for payloads of different cartridges 202.

In various embodiments, additional payload portions 208 may be interchangeable with payload portions of cartridges 202. For example, if the payload portion is located at the front or head of a projectile, the head section may be detached from an aft section (e.g., a portion of the projectile where the recovery device is located), and an additional payload portion 208 may be an interchangeable head for the projectile. In one embodiment, providing a plurality of cartridges 202 with different payloads may allow a user to quickly select and use a cartridge with a desired payload. In another embodiment, providing different payloads as additional payload portions 208, interchangeable with a payload portion of an existing cartridge 202 may provide a variety of payloads while avoiding the expense that might be associated with providing multiple complete cartridges 202

The targeting device 206, in one embodiment, determines range information for the drone to be interdicted. For example, a targeting device 206 may use a laser, radar, or the like to locate and determine a distance to a drone, a time to intercept a drone or the like. In a further embodiment, the targeting device 206 may be ground-based. In one embodiment, the targeting device 206 may be integrated with the launcher 204. In another embodiment, the targeting device 206 may be a separate device from the launcher 204. In a certain embodiment, the targeting device 206 may communicate with a projectile launched from a cartridge 202. For example, in one embodiment, the targeting device 206 may send range information to the projectile, and the projectile may trigger deployment of a set of tethers (or other payload) based on the range information. In another embodiment, the targeting device 206 may send a signal to deploy the tethers, so that electronics for determining when to deploy the tethers are based in the targeting device 206 instead of in the projectile.

In a certain embodiment, the projectile launched from the cartridge 202 may include communication electronics that receive the information from the targeting device, and trigger electronics that activate one or more pyrotechnic charges to deploy the set of tethers. In a further embodiment, the projectile may similarly include one or more pyrotechnic charges and trigger electronics for deploying a recovery device. In a certain embodiment, the targeting device 206 may communicate with the projectile using short-link wireless radio telecommunications. For example, in various embodiments, the targeting device 206 may communicate with the projectile using a Bluetooth wireless protocol, a Wi-Fi Direct wireless protocol, or the like.

Figure 3:
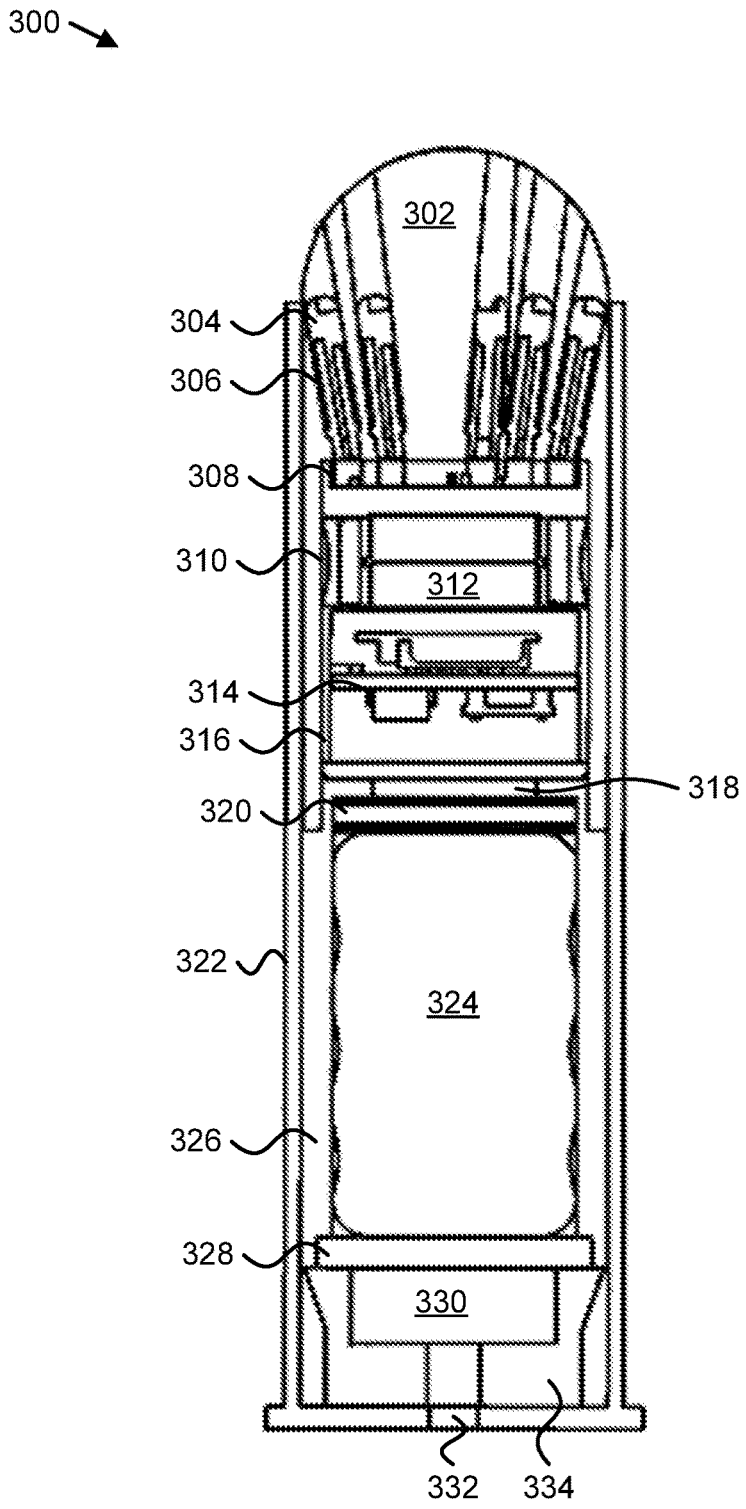
FIG. 3 is a cross section view illustrating one embodiment of a cartridge for drone interdiction.

FIG. 3 depicts a cross section of a cartridge 300 for drone interdiction. In certain embodiments, the cartridge 300 may be substantially similar to the cartridge 202 described above with reference to FIG. 2. In the depicted embodiment, the cartridge 300 includes a cartridge casing 322, propellant 330, a powder bushing 334, and a primer 332, which may be configured as in a standard flare cartridge. Additionally, in the depicted embodiment, the cartridge 300 includes a projectile (comprising the remainder of the depicted components) for intercepting a drone, which may be substantially similar to the projectile 106 described above with regard to FIGS. 1A-1F.

In the depicted embodiment, the projectile deploys tethers 306 from a housing 302 to secure a drone. The housing 302 includes channels formed in the housing for the tethers. In the depicted embodiment, the projectile includes a set of darts 304 that deploy from the projectile. A dart 304 may refer to any smaller projectile launched or deployed from the main projectile. The tethers 306 couple the darts 304 to the projectile so that deploying the darts 304 deploys the tethers 306. The tethers 306 may be spooled around the darts 304, or around spools that are retained within the projectile when the darts 304 are deployed.

In the depicted embodiment, the dart firing charge director 308 directs expanding gases from one or more pyrotechnic charges, for deploying the set of tethers 306 and the darts 304. In one embodiment, a dart firing charge director 308 may provide multiple chambers for individual dart-launching charges. In another embodiment, a single-chambered charge may launch the darts as gases from the charge expand through channels in the housing 302, without a dart firing charge director 308.

In the depicted embodiment, an electronics housing 316 houses communications and trigger electronics 314, electronics batteries 310, and trigger batteries 312. In certain embodiments, communication electronics may communicate with a separate device, such as a launcher, a ground-based targeting device, or other device controlled by a user for communicating range information, a trigger signal, or the like. The communications electronics may coordinate with trigger electronics to deploy the tethers 306, and/or a recovery device 324 (e.g., by triggering pyrotechnic charges). In one embodiment, the electronics batteries 310 power the communications and trigger electronics 314, and the trigger batteries 312 may provide power, managed by the trigger electronics, for triggering charges. In another embodiment, a single battery or power source may provide power for the communications and trigger electronics 314 and for triggering the charges.

In the depicted embodiment, a parachute housing 326 houses a parachute 324 for controlling descent of a recovered drone, a parachute charge 318 and wadding 320 for deploying the parachute 324, and a housing cap 328. The housing cap 330 may protect the parachute 324 or other recovery device from the heat of the propellant 330 when the cartridge 300 is fired, and may be ejected by the parachute charge 318 when the parachute 324 is deployed.

Figure 4:
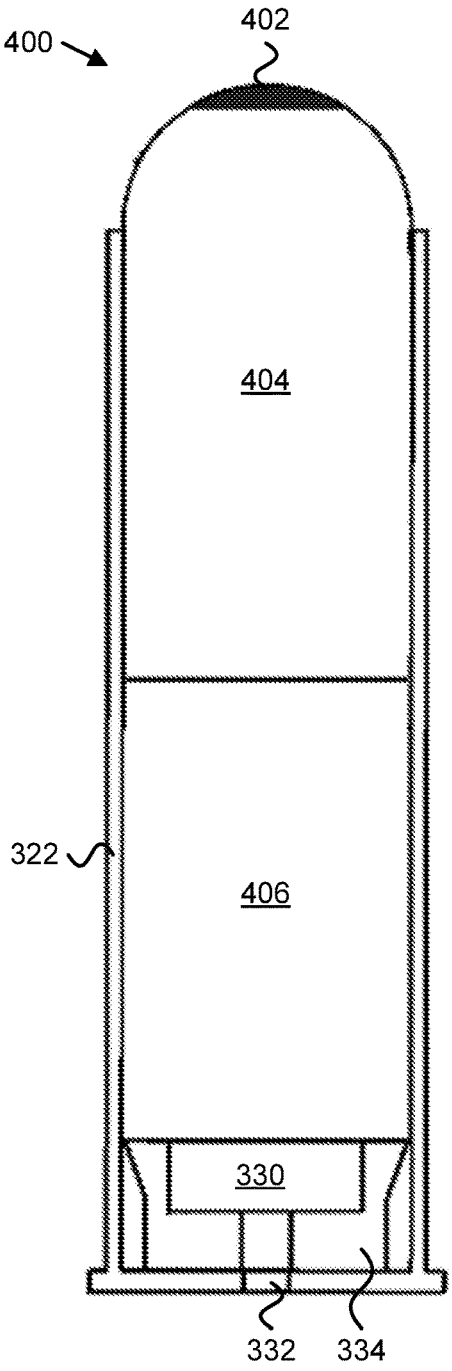
FIG. 4 is a cross section view illustrating another embodiment of a cartridge for drone interdiction.

FIG. 4 depicts a simplified cross section of a cartridge 400 for drone interdiction. In certain embodiments, the cartridge 400 may be substantially similar to the cartridge 202 described above with reference to FIG. 2, or to the cartridge 300 described above with reference to FIG. 3. In the depicted embodiment, the cartridge 400 includes a cartridge casing 322, propellant 330, a powder bushing 334, and a primer 332, which may be substantially as described above with reference to FIG. 3. Additionally, in the depicted embodiment, the cartridge 400 includes a weight-stabilized projectile comprising a head portion 404 and an aft portion 406.

In one embodiment, the head portion 404 may include tethers for securing a drone, or another payload for disabling a drone in another way, and the aft portion 406 may include a parachute or other recovery device. In another embodiment, tethers may be deployed from the aft portion 406 (e.g., for a projectile that deploys tethers after passing a drone), and the head portion 404 may include a parachute or other recovery device. Because the head portion 404 and the aft portion 406 may include different payloads or recovery devices in different embodiments, FIG. 4 does not depict specific payloads or recovery devices. However, the omission of specific components from FIG. 4 is not intended to imply that the head portion 404 or the aft portion 406 are empty.

In a certain embodiment, the projectile may be weight stabilized, so that the head portion 404 is heavier than the aft portion 406. In some embodiments, a head portion 404 that is heavier than an aft portion 406 of a projectile may stabilize the projectile, prevent the projectile from tumbling, or the like. Thus, in certain embodiments, heavier components, such as batteries, electronics, tethers, and weighted darts, may be disposed in the head portion 404, and lighter components such as a parachute may be disposed in the aft portion 406.

In certain embodiments, the aft portion 406 may comprise a composite material. For example, a housing for a parachute may comprise a carbon fiber composite, fiberglass composite, or other lightweight material. By contrast, a housing for electronics, tethers, or other components of the head portion may be made of stainless steel or other metal. The weight different between housing materials for the head portion 404 and the aft portion 406 may contribute to weight stabilization. Additionally, in some embodiments, a head portion 404 of a projectile may include one or more weights 402. A weight 402 may include a lead weight, a steel weight, or the like. In another embodiment, however, a projectile may be weight-stabilized by distributing the weight of components without added weights 402.

In the depicted embodiment, the projectile is weight-stabilized. However, in another embodiment, a projectile for intercepting a drone may be spin-stabilized (e.g., using a launcher with a rifled barrel) or may be fin-stabilized, ribbon-stabilized, or the like (e.g., fins or ribbons may deploy from the aft portion 406 of the projectile after the projectile is launched).

In one embodiment, the head section 404 comprises a payload portion of the cartridge, with a payload that deploys to disable a drone. In a further embodiment, additional payload portions may be interchangeable with the head section 404.

Figure 5A:
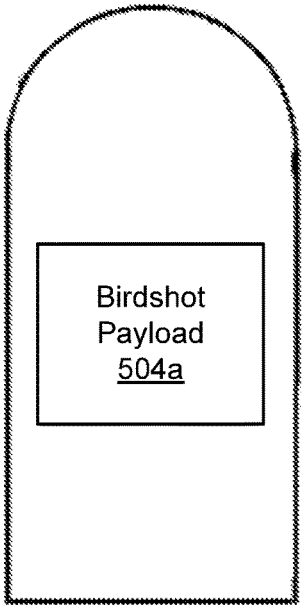
FIG. 5A is a side view illustrating one embodiment of an additional payload portion.
Figure 5B:
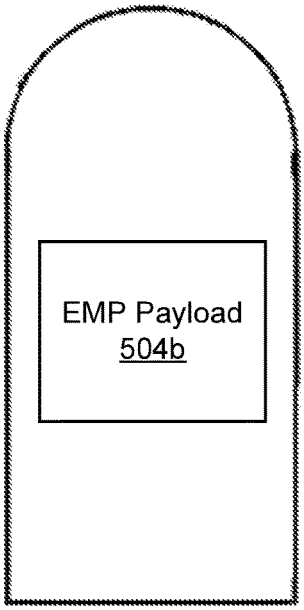
FIG. 5B is a side view illustrating another embodiment of an additional payload portion.

FIGS. 5A and 5B depict additional payload portions 504, interchangeable with the head portion 404 of FIG. 4. In FIG. 5A, a head portion includes a birdshot payload 504*a*. In certain embodiments, birdshot may be fired to destructively disable a drone. In FIG. 5B, a head portion includes an EMP payload 504*b* for disabling drone electronics. Providing different payloads in interchangeable head portions of projectiles may allow a user to determine a desired method for disabling or interdicting a drone. For example, a user may use a head portion with tethers to disable a drone in a populated area where a falling drone might injure people, but might prefer to destructively disable a drone (e.g., using birdshot or an EMP) in a less populated area.

Figure 6A:
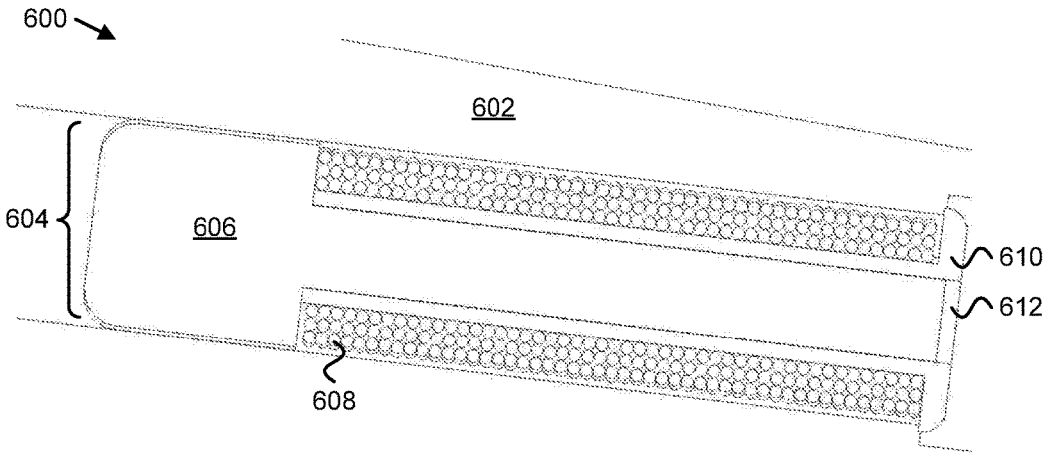
FIG. 6A is a cross section view illustrating one embodiment of a dart and spool for a tether.
Figure 6B:
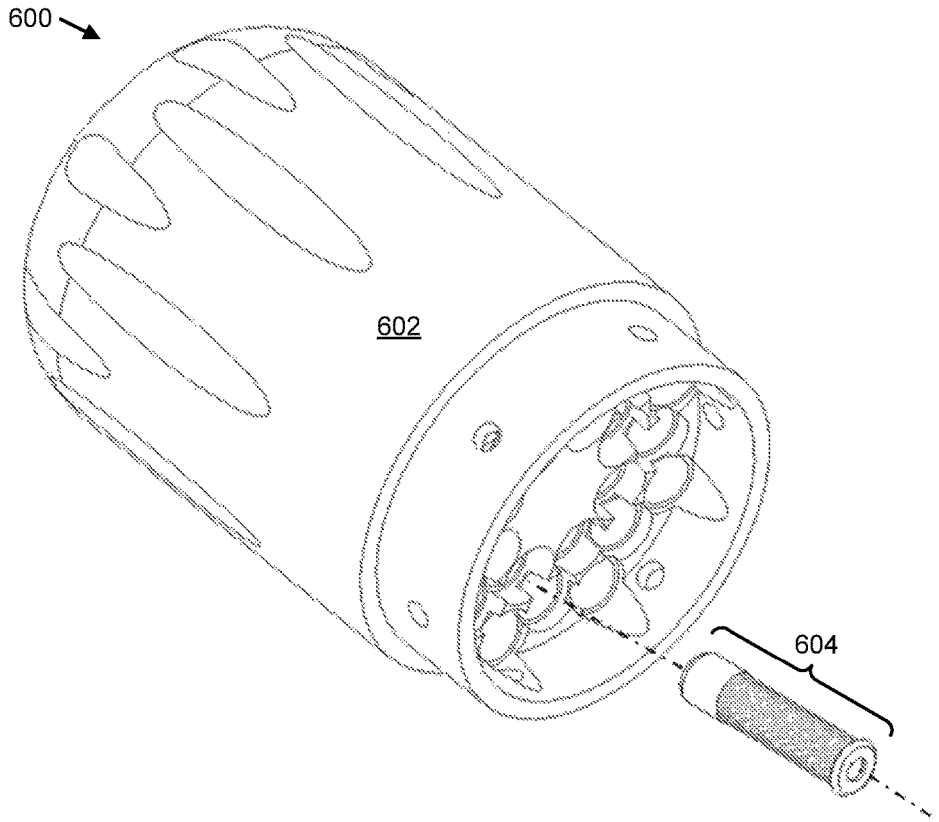
FIG. 6B is a perspective view illustrating a further embodiment of a dart and spool for a tether.

FIGS. 6A and 6B depict one embodiment of a dart and spool apparatus 600 for storing and deploying tethers for disabling drones. FIG. 6A depicts a cross section for a single dart and tether. In the depicted embodiment, the apparatus 600 include a housing 602, which may be substantially similar to the housing 302 of FIG. 3, and includes channels for deploying tethers. A tether 608 is coupled to a dart 606 and a spool 610. The tether 608 is wound around the spool 610 for storage, so that the spool 610 stores the tether 608 within the projectile. The dart 606, in the depicted embodiment is held in a hollow portion 612 that extends from the back to the front of the spool 610, so that a pyrotechnic charge behind the spool 610 can launch the dart. A back portion of the spool 610 is wider than a channel in the housing 602, so that the spool 610 can be inserted or removed from the back of the housing 602, but is retained in the projectile when the dart 606 and the tether 608 are deployed.

In the depicted embodiment, the dart 606, tether 608, and spool 610 comprise a spool assembly 604. FIG. 6B depicts a spool assembly 604 being loaded into the housing 602: the spool assembly 604 is simply inserted into a channel, from the back of the housing 602. Although one dart 606, tether 608, and spool 610 are depicted, a plurality of spool assemblies 604 may be provided for a plurality of channels in the housing 602. A dart 606 may be deployed out the front of the housing 602, while the spool 610 is retained in the housing 602. Thus, deploying the dart 606 deploys the tether 608, and the tether 608 remaining coupled to the dart 606 and the spool 610 can secure a drone to a projectile that includes the housing 602, for controlled interdiction and recovery of the drone.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus for drone interdiction, the apparatus comprising:

a projectile capable of being launched to intercept a drone, the projectile comprising:

a set of tethers that deploy from the projectile for securing the drone;

a recovery device that deploys from the projectile for controlling a descent of the drone; and a set of spools that store the set of tethers within the projectile, wherein a spool is insertable and removable from the projectile for loading a tether, and is retained within the projectile when the tether is deployed.

2. The apparatus of claim 1, the projectile further comprising a set of darts that deploy from the projectile, wherein the tethers couple the darts to the projectile such that deploying the darts deploys the tethers.

3. The apparatus of claim 1, wherein a tether comprises a metallic wire.

4. The apparatus of claim 1, wherein the apparatus comprises a cartridge for launching the projectile, the cartridge comprising a cartridge casing, propellant, primer, and the projectile.

5. The apparatus of claim 4, wherein the cartridge is compatible with one of: a 37 mm flare launcher, and a 40 mm grenade launcher.

6. The apparatus of claim 4, further comprising a second cartridge compatible with a launcher for the cartridge, the second cartridge comprising a projectile for intercepting a drone, the projectile of the second cartridge comprising a payload different from the set of tethers, the payload comprising one or more of a birdshot payload, an electromagnetic pulse generator payload, an incendiary payload, a marker payload and a tracking device payload.

7. The apparatus of claim 1, wherein the projectile comprises a payload portion, the payload portion comprising the set of tethers, the apparatus further comprising one or more additional payload portions interchangeable with the payload portion comprising the set of tethers.

8. The apparatus of claim 1, wherein the projectile further comprises a plurality of pyrotechnic charges for deploying the set of tethers and the recovery device, and trigger electronics for activating the pyrotechnic charges.

9. The apparatus of claim 1, wherein the projectile is configured to deploy the set of tethers based on one or more of: range information communicated to the projectile from a device separate from the projectile, range information set by a user prior to launching the projectile, a delay time, and target detection by the projectile.

10. The apparatus of claim 1, wherein the set of tethers and the recovery device remain coupled to the projectile after being deployed, such that the projectile is recoverable with the drone.

11. The apparatus of claim 1, wherein the projectile is reusable by replacing the set of tethers, repackaging the recovery device, and reloading one or more pyrotechnic charges.

12. The apparatus of claim 1, wherein the projectile is weight-stabilized, the projectile comprising a head portion and an aft portion, the head portion comprising one or more weights and the aft portion comprising a composite material.

13. A system comprising:

a cartridge comprising:

a projectile for intercepting a drone, a set of tethers that deploy from the projectile for securing the drone, a recovery device that deploys from the projectile for controlling a descent of the drone, and a set of spools that store the set of tethers within the projectile, wherein a spool is insertable and removable from the projectile for loading a tether, and is retained within the projectile when the tether is deployed; and a launcher for firing the cartridge to launch the projectile.

14. The system of claim 13, further comprising a ground-based targeting device that determines range information for the drone and communicates with the projectile.

15. The system of claim 14, the projectile further comprising communication electronics that receive the information from the targeting device, and trigger electronics that activate one or more pyrotechnic charges to deploy the set of tethers.

16. The system of claim 14, wherein the targeting device communicates with the projectile using short-link wireless radio telecommunications.

17. The system of claim 13, further comprising a second cartridge compatible with the launcher, the second cartridge comprising a projectile for intercepting a drone, the projectile of the second cartridge comprising a payload different from the set of tethers.

* * * * *